United States Patent [19]

Bede

[11] Patent Number: 4,657,483

[45] Date of Patent: Apr. 14, 1987

[54] SHROUDED HOUSEHOLD FAN

[76] Inventor: James D. Bede, 24510 Lake Rd., Bay Village, Ohio 44140

[21] Appl. No.: 671,931

[22] Filed: Nov. 16, 1984

[51] Int. Cl.[4] ..... F04D 29/52

[52] U.S. Cl. ..... 415/182; 415/210; 415/219 R; 416/247 R

[58] Field of Search ..... 415/182, 209, 210, 213 C, 415/215, 121 G, 185, 186, 216, 217, 219 R; 416/247 R, 246

[56] References Cited

U.S. PATENT DOCUMENTS

| | | | |
|---|---|---|---|
| D. 195,287 | 5/1963 | Downing | D23/155 |
| 1,993,158 | 3/1935 | Funk | 415/208 UX |
| 2,027,745 | 1/1936 | Montgomery | 415/208 X |
| 2,154,313 | 4/1939 | McMahan | 415/209 UX |
| 2,536,130 | 1/1951 | Herrman | 415/213 C |
| 2,554,602 | 5/1951 | Sutton | 415/182 |
| 2,628,019 | 2/1953 | Koch | 415/208 X |
| 2,640,646 | 6/1953 | Jones | 415/209 |
| 3,146,007 | 8/1964 | Boivie et al. | 415/209 UX |
| 3,169,694 | 2/1965 | Borchers | 415/213 C |
| 3,481,534 | 12/1969 | Price | 415/209 X |
| 3,519,367 | 7/1970 | Lariviere | 415/185 |
| 4,123,197 | 10/1978 | Keem et al. | 415/209 X |
| 4,140,433 | 2/1979 | Eckel | 415/2 |
| 4,189,281 | 2/1980 | Katagiri et al. | 415/213 C |
| 4,341,151 | 7/1982 | Sakamoto | 416/247 R X |

FOREIGN PATENT DOCUMENTS 2838392 3/1980 Fed. Rep. of Germany ..... 415/182

*Primary Examiner*—Robert E. Garrett
*Assistant Examiner*—Joseph M. Pitko
*Attorney, Agent, or Firm*—Sixbey, Friedman & Leedom

[57] ABSTRACT

An extremely efficient, substantially noiseless portable fan suitable for household use is provided which produces a highly focused, homogeneous stream of substantially laminar flow air to achieve effective air movement and cooling throughout an entire room. The fan includes a torus-shaped shroud, the intake portion of which has aerodynamic configuration having a precisely engineered geometry to minimize turbulence and promote laminar flow. The shroud intake portion includes an exterior angled Venturi surface, which extends toward the shroud intake orifice, to intersect with a radiused edge which joins the Venturi surface with an interior aerodynamic surface. An impeller assembly including a central bullet-shaped nose cone and a plurality of aerodynamically-configured radial blades are mounted within the shroud to further minimize turbulence and promote smooth air flow. In addition, an array of radial vanes supported within the shroud further reduces turbulence and directs the air flow from the fan in a concentrated stream.

21 Claims, 9 Drawing Figures

SHROUDED HOUSEHOLD FAN

TECHNICAL FIELD

The present invention relates generally to portable fans for domestic use and specifically to a portable fan having an aerodynamic shroud configuration designed to maximize fan performance and efficiency.

BACKGROUND ART

Ever since the factories of the Industrial Revolution gave birth to the world's earliest mechanical fans to cool workers who toiled in their hot, steamy environs, much effort has been devoted to improving the cooling efficiency of subsequent generations of mechanical fans. Fans intended for domestic use have, over the years, undergone many modifications which have shared the common goal of providing improved cooling. Although basic fan design has appeared to have changed little since the early mechanical fans, the often subtle differences in such features as rotor arrangement, blade configuration and housing shape in the prior art have all been effected in an attempt to provide improved air circulation by the fan and hence, increased cooling of the fan's intended environment.

Some of the prior art has focused on modifying various features of either the fan impeller or housing or both to affect the flow pattern or velocity of the air flowing through the fans, thereby maximizing efficiency. For example, Borchers, in U.S. Pat. No. 3,169,694, discloses a casing for a propeller fan having a bell-shaped mouth or inlet wherein the fan blades are positioned significantly downstream of the inlet so that the fan produces a controlled vortex flow of air having a predetermined angular velocity to move a maximum quantity of air through the fan in any particular time. In U.S. Pat. No. 2,154,313, McMahan discloses a propeller fan which has a cylindrical housing with an outwardly flaring edge which provides an intake orifice for guiding air from outside the casing into the fan blades prior to distribution by directing vanes. Neither of these fan housings, however, directs air into the fan in a manner which promotes laminar flow or reduces noise.

Katagiri et al in U.S. Pat. No. 4,189,281 disclose a housing or shroud for an axial flow fan which may be varied in shape to regulate the flow of air into the intake side of the fan. This fan, however, relies on the combination of both a shroud and the insertion of auxiliary fan blades within the shroud to achieve increased air flow from the fan while decreasing operating noise levels.

Structure to increase fan operating efficiency in the form of a shroud or annulus surrounding a propeller fan is disclosed by Herrman in U.S. Pat. No. 2,536,130. The shroud or annulus includes a rounded edge on the upstream side of the fan which results in a gradual increase in the velocity of the air moved by the fan blade tips. The width of the shroud relative to the size of the fan discharge orifice must be carefully controlled to achieve the operating efficiency of this fan. Although the arrangement and shroud configuration proposed by Herrman may result in a more efficient fan operation than other prior art fan designs, it still falls short of the efficiencies desired in a domestic fan intended to cool an entire room. The Herrman fan design, moreover, does not include structure which will cause a reduction in the noise which typically accompanies the operation of this type of fan.

An apparatus including a shroud structure which forms a wind gathering venturi and provides a streamlined wind collecting inlet and exhausts air with a minimum of turbulence is disclosed by Eckel in U.S. Pat. No. 4,140,433. This apparatus, however, is intended for use as a power-generating wind turbine capable of generating substantially more power than a conventional windmill and, as disclosed, is highly unsuitable for use as a portable household fan of the type commonly employed for cooling.

The prior art, therefore, fails to disclose a portable fan which operates aerodynamically, in a substantially noise-free manner, to efficiently move air in a laminar flow pattern throughout the surrounding environment to effectively cool this space.

SUMMARY OF THE INVENTION

It is an object of the present invention, therefore, to overcome the disadvantages of the prior art discussed above and to provide a portable fan having an aerodynamic configuration which efficiently and noiselessly circulates a stream of air throughout the fan environment.

It is another object of the present invention to provide a portable household fan which produces a homogeneous stream of air having laminar flow characteristics for circulation throughout the fan environment.

It is still another object of the present invention to provide a portable fan including an impeller mounted within a torus-shaped shroud which has an aerodynamic intake office profile specifically shaped to create air flow through the fan characterized by minimum turbulence to produce a highly focused beam of air from the shroud discharge orifice.

It is yet another object of the present invention to produce a portable fan having a torus-shaped shroud configured to create a Venturi effect on the ambient air situated along the exterior surface of the shroud which results in the substantially noise-free efficient operation of the fan.

It is a further object of the present invention to provide a portable fan having an aerodynamic shroud and impeller configuration for noiselessly and efficiently circulating ambient air within the fan's environment.

The foregoing objects are achieved by providing a portable fan which includes an impeller mounted within a torus-shaped shroud having an intake orifice and a discharge orifice for, respectively, pulling environmental air into and directing a substantially homogeneous stream of air from the fan. The shroud intake orifice has a size-dependent aerodynamic profile with a geometry specifically designed to create a smooth laminar flow of air through the fan with only minimal turbulence. The shroud intake orifice includes an outer angled, Venturi surface, a radiused edge and an inner aerodynamic surface which cooperatively function to create a Venturi effect along the Venturi surface portion of the shroud and within the fan. The discharge orifice is smaller in diameter than the intake orifice, and preferably includes positioned therein a plurality of radially extending aerodynamically-configured directing vanes. The fan impeller includes a central bullet-shaped nose cone which extends into the inlet orifice and supports a plurality of radially extending blades. The impeller is mounted within the shroud on the shaft of a suitable motor. Protective grills may be employed to cover the intake and discharge orifices, and a supporting stand may be adjustably mounted to the shroud.

Other objects and advantages of the present invention will be apparent from the following detailed description, claims and drawings.

BEST MODE FOR CARRYING OUT THE INVENTION

The portable fan of the present invention employs a combination of components, each having a precisely designed geometric configuration, which function synergistically to produce a homogenous laminar flow stream of air with minimal noise, vibration and energy usage. The highly focused stream of air produced by the present fan causes room air to circulate in a manner to be explained in detail hereinbelow which produces gentle but steady secondary air currents that are able to fill completely an interior room, thereby increasing significantly the comfort of the room's occupants. The unique interaction of the specific geometries of the components, particularly the fan housing or shroud, of the present fan results in a significant improvement in air movement and cooling over prior art fans while concomitantly reducing the energy required for efficient operation as well as substantially eliminating the noise which accompanies the operation of prior art fans.

Figure 1:
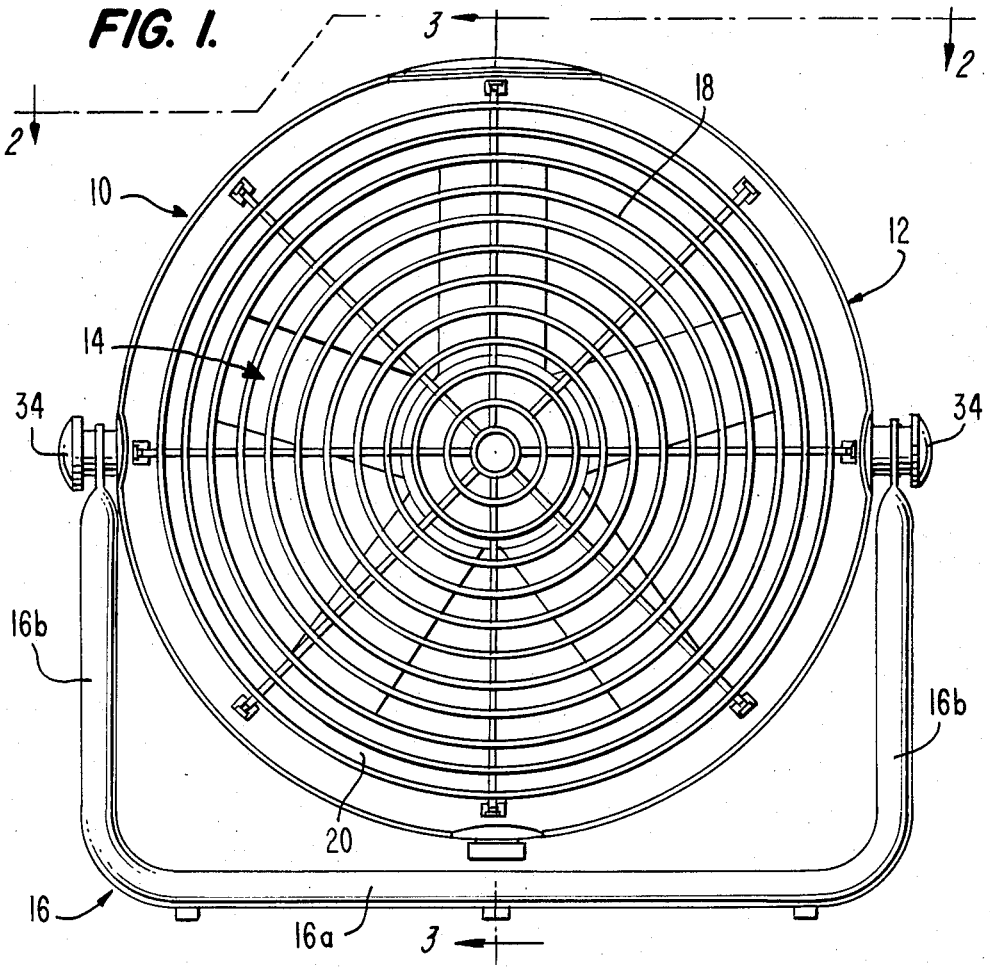
FIG. 1 is a front elevational view upstream of the intake orifice of the fan of the present invention.

Referring to the drawings, FIG. 1 illustrates a front elevational view of the present fan 10 as it appears from upstream of the air intake side. The fan includes a torus-shaped housing or shroud 12 within which is mounted an impeller assembly 14 and which may be adjustably supported by a support bracket 16. A protective grill 18 may be attached to the air intake side of the shroud 12 to block access to the impeller assembly while the fan is in operation. A similar protective grill 19 (shown in FIGS. 2 and 3) may also be attached to the opposite or air discharge side of the shroud 12. It will be noted from FIG. 1 that the torus-shaped shroud 12 presents a symmetrical circular shape in end view. The specific geometries of the components described herein, and in particular the shroud, are all based on an impeller assembly having a diameter of about 12 inches. It has been discovered that the maximum operating efficiencies possible with the present fan are not achieved if the fan is simply scaled up or scaled down in size. The specific geometry of the shroud in particular is size dependent and, hence, would have to be totally redesigned to produce a fan which generates the kind of laminar flow air stream with the minimal energy requirements and noiseless operation of the fan described herein.

Figure 2:
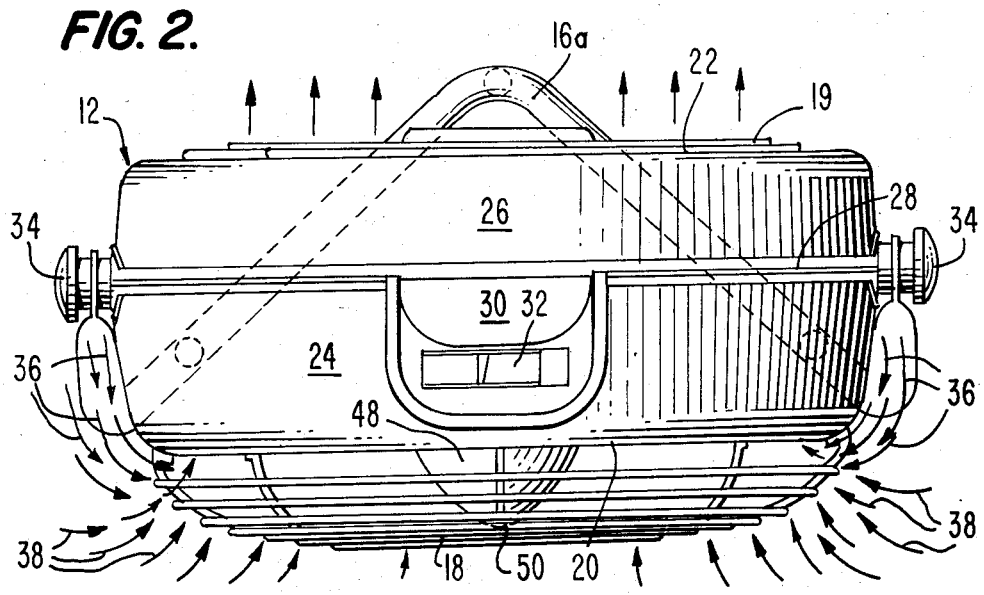
FIG. 2 is a top plan view of the fan of the present invention taken along line 2—2 of FIG. 1.

FIG. 2, in which the present fan is viewed looking down from the top of the shroud 12 in the direction of arrows 2—2 of FIG. 1, illustrates the exterior shroud configuration and some features of the air flow pattern. The torus-shaped shroud 12 defines an intake orifice 20 through which ambient air enters the fan and a discharge orifice 22 through which a stream of air characterized by substantially laminar flow exits the fan to circulate throughout the fan's environment. The shroud 12 has a generally torus-shaped configuration and includes an intake portion 24 and a discharge portion 26 joined by an annular ridged seam 28. Molded integrally into the top of the intake portion of the shroud is a depression 30 which forms a convenient handle for carrying the fan. A switch assembly 32 which activates the fan motor and preferably regulates motor speed may also be located on the intake portion of the shroud as shown. Additionally, if a supporting bracket 16 is employed, adjustable mounting knobs 34 may also be located on the shroud 12 as illustrated in FIG. 2.

When the fan motor (not shown) is activated by the switch assembly 32, air is directed into the intake orifice 20 substantially along the paths of the arrows 36. The shape of the shroud intake portion 24 surrounding the intake orifice 20 must have a specific precise geometry to produce the extremely efficient operation achieved by the fan of the present invention. The shroud intake portion has a generally aerodynamic configuration which effectively reduces the cross-sectional area of the air flow into the fan, thus causing the air to move faster in the vicinity of the impeller blades. The exact geometry of the shroud intake portion 24, which can best be seen in FIG. 3, was carefully derived to achieve maximum operating efficiencies. The intake portion of the shroud of the present fan, unlike the Venturi effect-creating shrouds of the prior art, directs the flow of air into the shroud interior and toward the impeller in a manner which minimizes turbulence and creates a smooth laminar air flow to form a highly focused beam of laminar flow air which typically remains extant for distances of up to 20 feet from the shroud discharge orifice.

Figure 3:
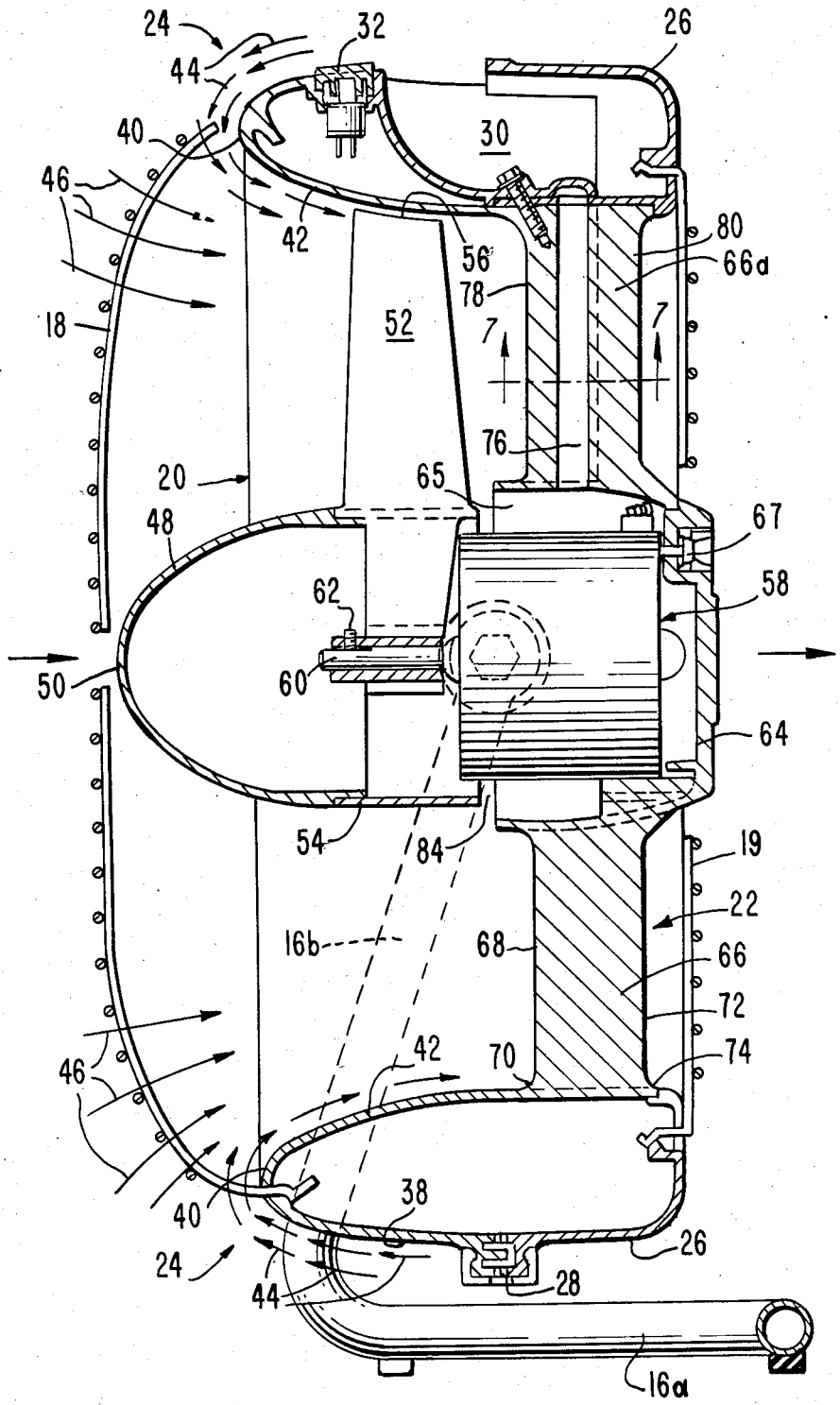
FIG. 3 is a cross-sectional view of the fan of the present invention taken along line 3—3 of FIG. 1.

FIG. 3 illustrates, in cross-section, the fan of the present invention, including the precise geometry of the shroud intake portion 24 which results in the superior performance of this fan. The shroud intake portion 24 includes an exterior angled Venturi surface 38 which extends at an angle away from the shroud annular ridged junction or seam 28 and the substantially horizontal discharge portion surface toward the center of the intake orifice 20, a radiused edge 40, which forms the outermost extent of the shroud intake portion, and an interior aerodynamic surface 42 which extends from the radiused edge 40 toward the shroud discharge orifice. The exact radius of curvature of radiused edge 40 must be carefully calculated relative to the impeller diameter and shroud dimensions. Consequently, the radius of curvature of edge 40 shown in FIG. 3 cannot be used to achieve the same highly efficient results in a fan with a larger or small diameter impeller or shroud.

Figure 4:
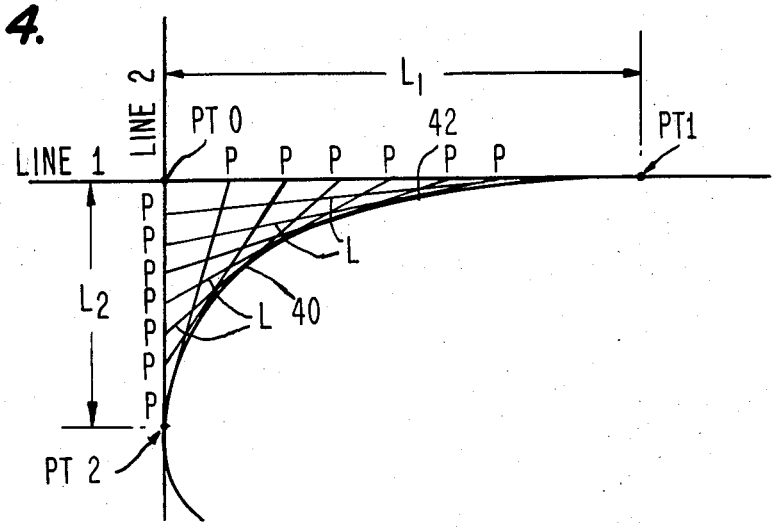
FIG. 4 is a diagrammatic view of part of the shroud intake portion showing its geometry.

FIG. 4 illustrates diagrammatically the manner in which the precise curve of radiused edge 40 is geometrically derived. Line 1 is drawn tangent to point PT1 and Line 2 is drawn tangent to point PT2 on the aerodynamic surface 42 and the radiused edge 40, respectively, so that they intersect at point PTO. Line 1 has length $L_1$ between points PT1 and PTO, which may range from 1/6 to 1/10 of the diameter of the interior of the shroud 12, and Line 2 has length $L_2$ between points PT2 and PTO, which may range from 1/12 to 1/20 of the interior shroud diameter. Lines $L_1$ and $L_2$ are divided into equal segments at points P, and lines L are then developed to connect the points P as shown in FIG. 4. A curve may then be generated which extends from PT2 to PT1 and is just tangent to the lines L. This procedure will produce the optimum radius of curvature for radiused edge 40 and, therefore, the optimum aerodynamic shape for fans with interior shoud diameters ranging from about 4 inches to about 24 inches.

The profile of the shroud intake portion shown in FIG. 3 creates a Venturi effect along the exterior surface of the shroud, causing ambient air to be drawn along the angled Venturi surface 38, around the radiused edge 40 and along the aerodyanmic surface 42 as depicted by the arrows 44 in FIG. 3 and arrows 36 in FIG. 2. Air is also drawn into the interior of the shroud along paths such as those shown by arrows 46 in FIG. 3 and arrows 38 in FIG. 2. A substantially even flow of air is thus directed into the fan, which has the surprising effect of essentially eliminating the operating noise. If, however, the flow of air along the angled Venturi surface 38 is blocked, the fan ceases to operate noiselessly and begins to generate an operating noise characteristic of prior art fans.

To contribute further to the efficient aerodynamic flow of air through the fan, the impeller assembly 14 includes a nose cone or spinner 48 having a smooth, bullet-shaped configuration with the small diameter smoothly rounded end 50 extending upstream of the impeller assembly through the intake orifice 20. This nose cone configuration promotes the smooth, nonturbulent flow of air into the impeller assembly. The combination of the centrally positioned bullet-shaped nose cone and the profile of the shroud intake portion discussed above further allows air to be directed into the fan impeller evenly and smoothly so that the flow is substantially laminar in nature and turbulence is effectively minimized.

Figure 5:
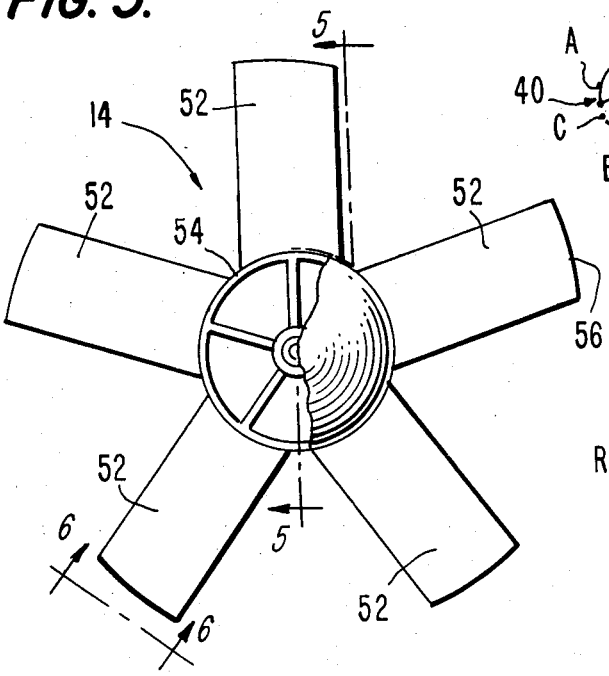
FIG. 5 is a front view from the intake orifice of the impeller assembly of the fan of the present invention with the nose cone portion partially cut away.

The impeller assembly 14, which is shown in front view in FIG. 5, also includes a plurality of blades 52. Although five blades are shown in FIG. 5, other numbers of blades may be effectively employed. The blades 52 extend radially from a central hub 54 so that the tips 56 of the blades 52 are disposed in close proximity to the aerodynamic surface 42. The contour of each blade tip 56 is precisely shaped to correspond to the contour of the aerodynamic surface 42 of the shroud along the entire length of the blade tip. When the impeller assembly has an effective diameter of about 12 inches, the blade tips 56 should be no more than about 0.06 inch from the shroud aerodynamic surface. This close spacing prevents air accelerated by the blades 52 from moving radially outward from the blade tip, thereby reducing turbulence and increasing the amount of air moved through the fan.

Figure 6:
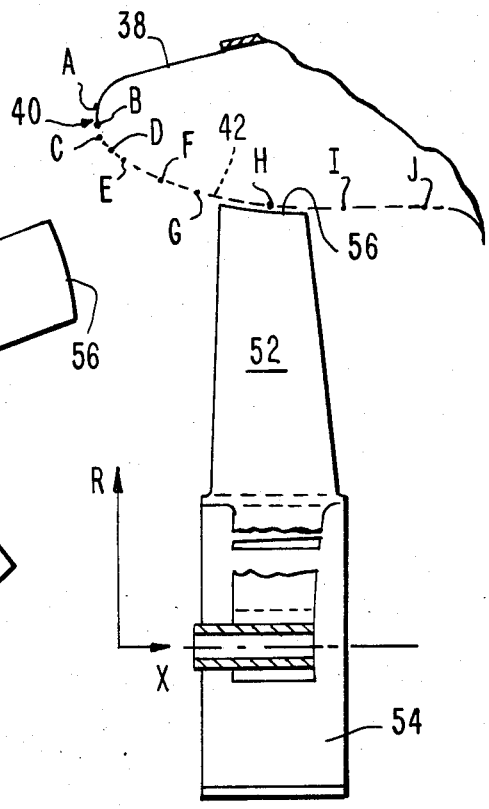
FIG. 6 is a cross-sectional view taken along line 5—5 of FIG. 4 showing the relationship between the impeller blade tips and the shroud.

FIG. 6 illustrates the position of a blade tip 56 relative to the profile of the radiused edge 40 and the aerodynamic surface 42 of the shroud intake portion. The location of points A through J on the shroud measured on the coordinates R and X shown in FIG. 5 is set forth in the table below.

| POINT | R | X |
|---|---|---|
| A | 7.430 | .000 |
| B | 7.185 | .050 |
| C | 7.070 | .100 |
| D | 6.850 | .250 |
| E | 6.715 | .400 |
| F | 6.420 | .900 |
| G | 6.250 | 1.400 |
| H | 6.050 | 2.400 |
| I | 5.985 | 3.400 |
| J | 5.950 | 4.500 |

Figure 7:
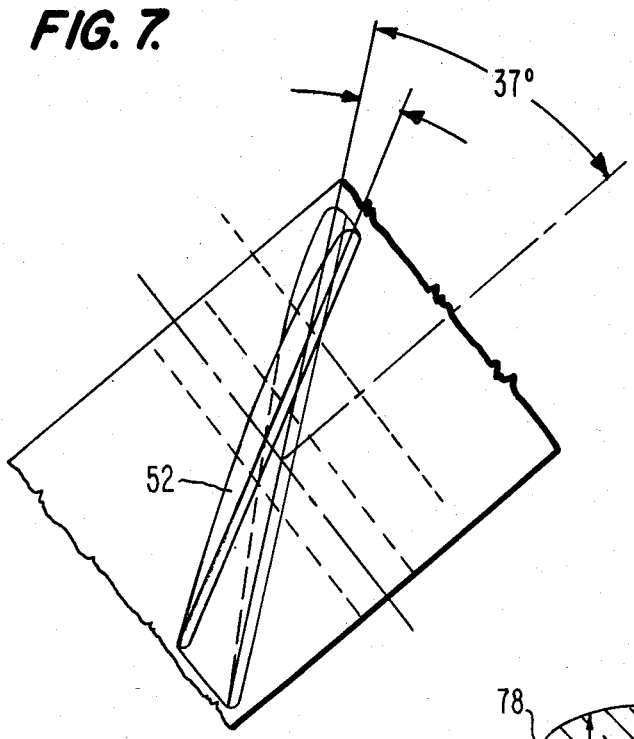
FIG. 7 is a view of the impeller blade looking in the direction of 6—6 of FIG. 4.

The exact twist of the blades 52 of the impeller assembly has further been calculated to achieve maximum operating efficiency. As shown in FIG. 7, the blades 52 decrease in pitch with increasing radial distance from the hub 54. The effect of this decrease in pitch is to permit the blades to operate at or near aerodynamic efficiency along the substantially the entire blade length. At the hub 54, the chord of the blade 52 is oriented at an angle of about 37° to a plane normal to the axis of rotation of the hub 54. At the blade tip this angle is reduced to about 27°.

The impeller assembly 14 is driven by a suitable motor 58 which has a shaft 60 substantially coaxial with the axis of the shroud 12. The impeller assembly hub 54 is secured to the motor shaft 60 by suitable means, such as the set screw 62 shown in FIG. 3. Because of the operating efficiencies achieved by the fan shroud configuration, the kind of motor selected to power the present fan does not have to be as powerful as those required to power prior art fans which rely primarily on moving the fan blades faster to increase the amount of air moving through the fan. Any suitable motor which is capable of operating at preferably at least three speeds may be used as the power source for the aerodynamic fan of the present invention.

A motor housing 64 which is supported by a plurality or radially extending stationary struts or vanes 66 is positioned just inside and upstream of the shroud discharge orifice 22. The motor housing 64 includes an opening 65 through which the motor 58 extends to engage the impeller assembly 14. The fan motor 58 is mounted by suitable fasteners, such as by nut 67, to the housing 64. It is preferred to employ an array of eight evenly spaced vanes which radiate outwardly from the motor housing so that outermost extent of the vanes terminates in a smooth, curved intersecting junction with the shroud. The upstream edge 68 of the vane 66 shown in FIG. 3 forms a smooth junction 70 with the interior aerodynamic surface 42 of the shroud, and the downstream edge 72 of vane 66 forms a smooth junction 74 with the discharge orifice defining portion of the shroud. It has been found to be convenient to provide at least one vane **66*a* which includes a conduit 76 through which the necessary wires or other connecting structure between the motor 58 and the switch assembly 32** may be housed. The wires or other connecting structure may thereby be concealed from view and kept out of the way of the functioning fan blades.

Figure 8:
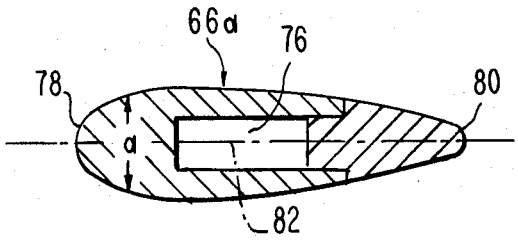
FIG. 8 is a cross-sectional view of the vanes positioned at the discharge orifice of the fan of the present invention taken along line 7—7 of FIG. 3.

The profile and configuration of the vanes has been selected to interact with the shroud and fan blades and further promote the efficient aerodynamic flow of air through the fan. FIG. 8 illustrates the profile of vane **66*a* in cross section. It should be noted that vane 66*a* will have a greater cross-sectional width a than the other vanes 66 to accommodate the connections between the switch assembly 32 and the motor 58. Therefore, if width a is about $\frac{3}{8}$ inch for vane 66***a*, the width at this point on one of the other vanes will be on the order of $\frac{1}{8}$ inch so that the vanes 66 are in actuality very thin. Except for the presence of conduit 76, the other vanes will have a similar aerodynamic cross-sectional configuration. The general shape of the vanes resembles an airfoil and is symmetrical about an axis 82 which is parallel to the central axis of the impeller assembly 15. The upstream edge 78 of vane 66*a* will have a larger radius of curvature than the downstream edge 80. The vanes provide a smooth aerodynamic surface which has no angle of attack with respect to the axis of the air moving toward them, but which functions to reduce rotation in the flow of air leaving the blades 52 and to straighten the flow, thereby assisting in the production of a homogeneous stream of substantially laminar flow air from the discharge orifice.

An analysis of the air stream produced by the present fan has shown that this column of air may have a slight spiral twist to it. Consequently, in certain fan applications such as in clean rooms and the like where extremely precise control over air flow is required, this slight spiral could be eliminated from the air flow by providing trim tabs or similar structure (not shown) on the downstream edges 72 of the vanes 66.

The location and structure of the motor housing 64 has been selected to contribute further to the efficient operation of the present fan. As noted hereinabove, the motor housing 64 is positioned just upstream of the shroud discharge orifice and is, therefore, downstream of the impeller assembly 14 and blades 52. The operating temperature of the motor can be kept low by providing a constant flow of cooling air around the motor 58 while it is in operation, thus allowing the motor to operate more efficiently. The utilization of air driven by the radially innermost part of the blades 52 is directed through an annular opening 84 defined by the downstream edge of the hub 54 and the upstream opening 65 of the motor housing 64. The diameter of the motor housing upstream opening 65 is larger than the diameter of the hub 54, and the hub 54 terminates just upstream of the motor housing, thus creating the annular opening 84 through which cooling air can enter and circulate around the motor 58.

Figure 9:
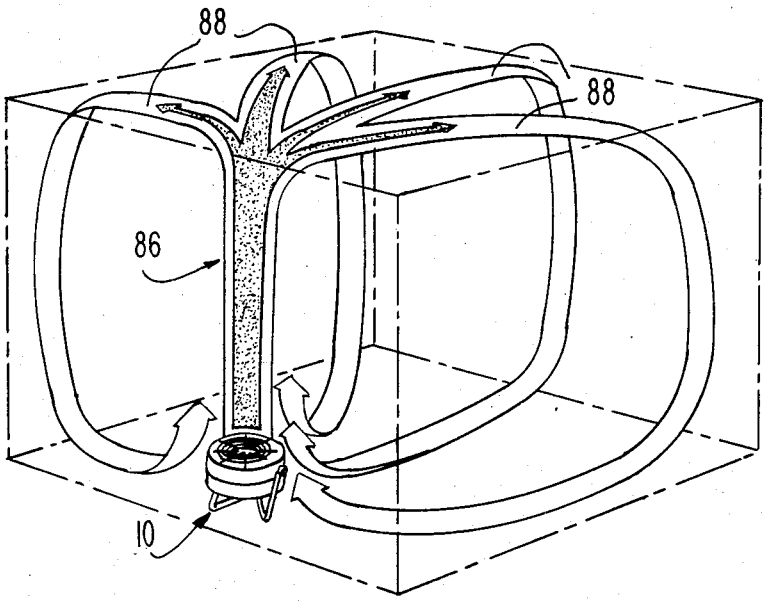
FIG. 9 is a perspective view of a closed area showing one type of air circulation pattern which may be achieved with the fan of the present invention.

To enhance its portability, the present fan is provided with an adjustable support bracket 16, which is preferably formed from a continuous tube bent to form a base section 16*a* and a pair of arm sections 16*b* which are rotatably attached to the shroud 12 by a pair of adjustment knobs 34. The shroud may therefore be rotated a full 360 degrees about the axis defined by the adjustment knobs 34 to direct the stream of air produced by the fan in any direction desired. The support bracket 16 may be conveniently employed either as a stand to support the fan on a flat surface, as shown in FIG. 9, or as a bracket to mount the fan on a wall or other vertical structure.

The efficiency of the shrouded fan of the present invention has been compared with other commercially available household fans and has been found to exceed significantly the operating efficiency achieved by these other fans. Tests were conducted comparing the "Jetstream", a fan manufactured according to the present invention and having a 12 inch diameter impeller assembly, a 12 inch fan marketed under the Patton name, and a 12 inch desk fan marketed under the Panasonic name. The tests determined the volume flow rate of air moved downstream by the fan per watt of power consumed. Air velocity measurements were made using an Alnor Velometer Jr. with a dual scale, and watts consumed were computed using a Powerstat Variable Autotransformer Model 1168 to control the line voltage to 115 volts. Amperage readings were taken with a Fluke No. 8024A Multimeter. The switches of all three fans were set on the highest speed. The air velocity shown in the average velocity over the area indicated. Outside this area, which was centered on the central axis of each fan, there was little or no detectable air movement. All tests were conducted on the same day and under the same operating conditions. To simulate accurately the typical working environment of the fan, no wind tunnels or other means of channeling the air from any of the fans was used. A summary of the test data is set forth in the table below.

| | JETSTREAM | PATTON | PANASONIC |
|---|---|---|---|
| SWT.SET | HI | HI | HI |
| R.P.M. | 1160 | 2475 | 1145 |
| WATTS | 109.6 | 94.8 | 46.4 |
| VEL(F.P.M.) | 957 | 658 | 725 |
| AREA ($FT.^2$) | 1.40 | .92 | .69 |
| VOL(C.F.M.) | 1340 | 607 | 500 |
| C.F.M./WATT | 12.23 | 6.34 | 10.78 |

The test results demonstrated that the "Jetstream" fan constructed in accordance with the present invention was at least 13 percent more efficient than its closest competitor, the Panasonic fan. This C.F.M. per Watt advantage is particularly significant when the types of motors used to power these two fans are compared. The Panasonic 12 inch fan employs a capacitor run motor, which is inherently substantially more efficient at converting electrical energy to mechanical power than is the shaded pole motor used in the "Jetstream" fan during the tests. Consequently, under actual working conditions the present fan produces substantially more cooling air per watt of power consumed than its nearest competitor. Even greater efficiencies, then, would result from equipping the present fan with a capacitor run motor.

FIG. 9 illustrates diagrammatically the way in which the present fan utilizes room air to create a Venturi effect within an entire room. When the fan 10 is positioned with the discharge orifice toward the room's ceiling, air is compressed within the fan to form a highly focused beam of air 86 which emerges from the shroud discharge orifice and is directed to the ceiling. This highly directed beam of air expands to form a number of separate air currents 88, only four of which are shown in FIG. 8. These separate air currents are then drawn downward through the room and into the shroud intake orifice. Once this air flow circulation pattern is established, substantially all of the air in the room is put in laminar flow motion with minimum turbulence. Once this homogeneous air flow condition is established with the present fan, a person situated anywhere in the room will feel a uniform cooling air flow over their entire body rather than the intermittent blasts of air characteristically produced by most household fans.

The width of the torus-shaped shroud 12 of the present fan, which is preferably formed of a molded plastic material characterized by high strength and light weight, allows it to serve as a mounting base on which various auxiliary devices may be mounted. The annular ridged seam 28 may also be employed to assist in mounting devices such as air cleaners, air ionizers, heating elements, ultraviolet germ killers, insect killers, air filters, air deodorizers and the like. Care must be taken to mount any auxiliary devices in a manner which does not interfere with the air flow into the shroud intake orifice.

INDUSTRIAL APPLICABILITY

The fan of the present invention will find its primary application in the domestic or household environment, where it can be used as a portable room fan, either in a hassock-type orientation as shown in FIG. 8 or mounted on a wall, as an exhaust fan, or as an auxiliary means to enhance the circulation of air-conditioned or heated air. In addition, however, since the present fan produces a substantially homogeneous column or stream of air which remains in that form for distances of at least 20 feet, it is especially effective and efficient for outdoor use. The discharge orifice end of the fan can be directed at an area to drive away mosquitos, flies or other insects while providing a cooling breeze. Likewise, it can be used in an open environment to drive insects away from food being displayed.

The fan described herein is also ideally suited for an office, factory or like environment. For example, there are many offices and factories that have one or more large electronic machines, such as copy machines, word processors, computers, and the like, which must be installed along an unventilated wall or in a corner. Although these machines are usually internally cooled, the room air often has little circulation, which results in overheating of the machines. The present fan is ideally suited for placement behind or next to such equipment to provide a homogeneous air flow around the machines to prevent the recirculation of hot air through the machines, thus maintaining the machines at a lower operating temperature and consequently extending their useful operating life.

Because the present fan creates a beam of homogeneous air, it can be used to dissipate heat from many sources of heating. It can be used to cool overhead lights in studios, auditoriums, theaters or the like. It can also be used to cool work areas near furnaces, ovens, heat exchangers, and the like. It can additionally be used to cool stationary engines and motors.

The fan of the present invention can be used to blow heat, dust, and fumes away from workmen in many types of factory work stations. For example, the present fan can be used at a distance to blow heat, sparks, and fumes away from welders. It can also be employed to blow fumes away from workmen around paint booths and chemical baths of various types. It can further be used to blow dust away from workmen at grinding machines and the like.

The uses and applications of the present invention set forth above are not intended to be limiting in any way, but are merely illustrative. Other end uses and applications of the aerodynamic fan described herein are also contemplated to be within the scope of the present invention.

I claim:

1. A portable fan including unitary shroud means having an exterior surface spaced outwardly from and substantially parallel to an interior surface along substantially the entire longitudinal dimension of said shroud means for directing air in a laminar flow pattern into an impeller assembly mounted within said shroud means, said shroud means including intake means extending from said shroud exterior surface to said shroud interior surface having an aerodynamic cross-sectional configuration for directing air along said exterior surface in a laminar flow pattern into said impeller assembly and discharge means for discharging a substantially homogeneous column of air during fan operation.

2. The portable fan described in claim 1, wherein said shroud means intake means defines an intake orifice and includes an exterior angled Venturi surface substantially contiguous with said shroud means exterior surface extending toward said intake orifice, an interior aerodynamic surface extending toward said discharge means substantially contiguous with said shroud means interior surface and a radiused edge connecting said exterior angled Venturi surface with said interior aerodynamic surface to form said aerodynamic cross-sectional configuration so that during fan operation, air is caused to flow into said intake means along a path defined by said angled Venturi surface, said radiused edge and said aerodynamic surface and is thereby directed into said impeller assembly and out said discharge means.

3. The portable fan described in claim 2, wherein said shroud means has a torus-shaped configuration with said interior surface on the inside of said torus and said exterior surface on the outside of said torus, and said intake means and said discharge means are connected by an annular ridged seam extending substantially completely along the, exterior surface of said shroud means and positioned so that said intake means extends along more than half of the width of said torus.

4. The portable fan described in claim 3 wherein said angled Venturi surface extends along more than half of the width of said shroud means.

5. The portable fan described in claim 1, wherein said impeller assembly includes hub means for supporting a plurality of radially extending blades, said hub means being situated coextensive with the central axis of said intake means and said blades extend from said hub means to said aerodynamic surface.

6. The portable fan described in claim 5, wherein said impeller means includes nose cone means mounted on said hub means for aerodynamically directing air flow through said intake means to said impeller assembly.

7. The portable fan described in claim 6, wherein said nose cone means has a bullet shaped configuration having a rounded intake end portion shaped to impart laminar flow characteristics to the air directed to said impeller assembly.

8. The portable fan described in claim 5, wherein each of said blades includes a tip end opposite said hub means and the configuration of said tip end corresponds to the configuration of said aerodynamic surface.

9. The portable fan described in claim 8, wherein the entire extent of the tip end of each of said blades is spaced a uniform distance from said aerodynamic surface.

10. The portable fan described in claim 9, wherein said uniform distance is 0.06 inches.

11. The portable fan described in claim 5, wherein the pitch of each of said blades decreases with increasing radial distance from said hub means.

12. The portable fan described in claim 5, wherein said shroud means includes a plurality of stationary strut means positioned immediately upstream of said discharge means and downstream of said impeller means for focusing and directing a substantially laminar flow stream of air from said discharge means.

13. The portable fan described in claim 12, wherein said strut means supports motor housing means positioned coaxial with said hub means for mounting a motor to drive said impeller assembly and extends radially outwardly from said motor housing means to said shroud means discharge means.

14. The portable fan described in claim 13, wherein each of said strut means has an aerodynamic cross-sectional configuration wherein the upstream edge of each of said strut means has a larger radius of curvature than the downstream edge of said strut means.

15. The portable fan described in claim 13, wherein said motor housing means includes motor cooling means for providing a constant flow of cooling air to said motor during motor operation.

16. The portable fan described in claim 1 wherein the diameter of said impeller means is 12 inches.

17. The portable fan described in claim 1 wherein adjustable bracket means is rotatably mounted on said shroud means for adjusting the orientation of said discharge orifice.

18. The portable fan described in claim 1, wherein said shroud means includes integral handle grip means for use in picking up and carrying said fan from place to place.

19. The portable fan described in claim 1, wherein said intake means and said discharge means are covered by protective grill means for limiting access to said impeller means.

20. A portable fan comprising:

a. unitary torus-shaped shroud means having an aerodynamic cross-sectional configuration for directing a flow of air in a laminar flow pattern therethrough to produce a focused stream of laminar flow air;

b. impeller means mounted within said shroud means and including an aerodynamically configured central nose cone and a plurality of aerodynamically configured radial blades for moving air through said shroud means in a laminar flow pattern with a minimum of turbulence;

c. vane means mounted within said shroud means downstream of said impeller means for reducing turbulence and promoting the discharge of a focused stram of laminar flow air from said shroud means; and d. motor means for driving said impeller means and causing said blades to rotate about said central nose cone.

21. A portable fan comprising:

a. an aerodynamically configured torus-shaped shroud including intake means for directing air in a substantially laminar flow pattern into the shroud to produce a substantially homogeneous column of air downstream of a discharge orifice defined in said shroud; said intake means including an intake orifice defined by a Venturi surface on the exterior of the shroud, an aerodynamic surface spaced inwardly from said Venturi surface along the shroud interior and a radiused edge connecting said Venturi surface and said aerodynamic surface;

b. impeller means supported by and mounted completely within the shroud for moving air through the shroud in a laminar flow pattern with a minimum of turbulence, said impeller means including an aerodynamically configured central nose cone supporting a plurality of aerodynamically configured radial blades having tips which extend toward and conform to the configuration of said aerodynamic surface;

c. aerodynamically configured vane means mounted within said shroud downstream of said impeller means for supporting a motor housing and promoting the discharge of said homogeneous column of air;

d. motor means mounted within said housing for driving said impeller means;

e. grill means for providing a protective barrier around said intake means and at said discharge orifice; and f. adjustable support means for adjustably supporting said shroud so that the direction of flow of said homogeneous column of air from said discharge orifice can be varied.

* * * * *